US007591025B2

(12) United States Patent
McGhee

(10) Patent No.: US 7,591,025 B2
(45) Date of Patent: Sep. 22, 2009

(54) ADJUSTABLE BANDANA

(76) Inventor: Kevin Llewellyn McGhee, 6465 Hadden Bay Dr., Florissant, MO (US) 63033

( * ) Notice: Subject to any disclaimer, the term of this patent is extended or adjusted under 35 U.S.C. 154(b) by 704 days.

(21) Appl. No.: 11/228,403

(22) Filed: Sep. 19, 2005

(65) Prior Publication Data

US 2006/0090245 A1 May 4, 2006

Related U.S. Application Data

(60) Provisional application No. 60/623,522, filed on Oct. 28, 2004.

(51) Int. Cl.
*A42B 1/00* (2006.01)

(52) U.S. Cl. ..... 2/206; 2/202; 2/204

(58) Field of Classification Search ..... 2/10, 2/171, 207
See application file for complete search history.

(56) References Cited

U.S. PATENT DOCUMENTS

| | | | | |
|---|---|---|---|---|
| 2,221,155 | A | 11/1940 | Stone | |
| 2,741,773 | A | 4/1956 | Wolfe | |
| 2,993,211 | A | 7/1961 | Sullivan | |
| 3,080,566 | A | 3/1963 | Neumann | |
| 3,260,292 | A | 7/1966 | Costello | |
| 3,373,447 | A | 3/1968 | Kim | |
| 3,381,309 | A | 5/1968 | Cohen | |
| 4,138,744 | A | 2/1979 | Pitzel | |
| 4,723,325 | A | 2/1988 | Perry | |
| 4,870,707 | A | 10/1989 | Hayes | |
| 5,035,006 | A | 7/1991 | Hetz | |
| 5,594,956 | A * | 1/1997 | Barrientos | 2/207 |
| 5,685,016 | A * | 11/1997 | Douglas | 2/171 |
| 5,906,006 | A | 5/1999 | Castro | |
| 6,026,514 | A | 2/2000 | Fricker | |
| 6,032,292 | A | 3/2000 | Wood | |
| 6,047,401 | A * | 4/2000 | Traumer | 2/10 |
| 6,145,131 | A | 11/2000 | Huff | |
| 6,226,799 | B1 | 5/2001 | Lane | |
| 6,247,181 | B1 | 6/2001 | Hirsch | |
| 6,360,374 | B1 | 3/2002 | Adler | |
| D458,004 | S | 6/2002 | Magdziak-Hautala | |
| 6,401,255 | B1 * | 6/2002 | Douglas | 2/207 |
| 6,640,342 | B2 | 11/2003 | Dixon | |
| 6,665,876 | B1 | 12/2003 | Newman | |
| 6,966,071 | B1 * | 11/2005 | Cascone | 2/195.2 |
| 2002/0083509 | A1 * | 7/2002 | Douglas | 2/172 |
| 2003/0070208 | A1 | 4/2003 | Magdziak-Hautala | |

FOREIGN PATENT DOCUMENTS

| | | |
|---|---|---|
| DE | 19730406 | 1/1999 |
| FR | 2781654 | 2/2000 |

* cited by examiner

*Primary Examiner*—Gary L Welch
*Assistant Examiner*—Alissa J Tompkins
(74) *Attorney, Agent, or Firm*—Richard C. Litman

(57) ABSTRACT

The adjustable bandana is adapted for covering a body part and includes a fabric sheet having an upper surface and a lower surface, with an absorbent layer being secured to the lower surface. The absorbent layer absorbs perspiration when the adjustable bandana covers a body part of the user. The adjustable bandana includes a pair of first fasteners secured to the upper surface for adjustably and releasably engaging a second fastener secured to the upper surface, allowing the user to adjustably and releasably secure the adjustable bandana to the selected body part. Further, the user may selectively display emblems secured to the fabric sheet when the adjustable bandana is worn by the user.

5 Claims, 8 Drawing Sheets

ADJUSTABLE BANDANA

CROSS-REFERENCE TO RELATED APPLICATION

This application claims the benefit of U.S. Provisional Patent Application Ser. No. 60/623,522, filed Oct. 28, 2004.

BACKGROUND OF THE INVENTION

1. Field of the Invention

The present invention relates to clothing, and particularly to headwear. More specifically, the present invention relates to an adjustable bandana that is adjustable to the diameter of the person's head. In some embodiments, the adjustable bandana is convertible for use as neckwear (e.g., as a cravat), as an arm sling, a support for an emergency, splint, etc.

2. Description of the Related Art

Soft fabric head coverings have often been worn by athletes and others who prefer lightweight, foldable, and easily transportable head coverings. Such head coverings are generally only adapted to mounting on the user's head. Such coverings are rarely adjustable and are typically sized and shaped only for the single use of headwear.

Further, typical fabric head coverings provide a single sheet of fabric, which, in a cold climate, offers little thermal insulation, and in a warm climate easily becomes soaked with the user's perspiration. It would be preferable to provide a multiple layer fabric covering, providing both thermal insulation and further providing for the absorption of perspiration and the easy evaporation of the collected perspiration.

In addition, bandanas do not have a mechanism for adjusting the size of the sheet forming the bandana, except for folding the fabric and tying the ends together. Knots tied to secure the bandana in this manner often become loose, making it difficult to tightly secure the bandana around the head to form and maintain a skullcap-type headcover, and makes the conventional bandana unsuitable for an adjustable length sling or the like. Thus, an adjustable bandana solving the aforementioned problems is desired.

SUMMARY OF THE INVENTION

The adjustable bandana is made from a fabric sheet having an upper surface and a lower surface, with an absorbent layer being secured to the lower surface. When worn as headgear, the absorbent layer absorbs perspiration from the user's forehead and scalp, thus preventing perspiration from dripping into the user's eyes and further providing a cooling effect through evaporative cooling. When worn in a cold climate, the absorbent layer provides additional thermal insulation for the user.

The adjustable bandana includes a pair of first fasteners secured to the upper surface for adjustably and releasably engaging a second fastener secured to the upper surface, allowing the user to adjustably and releasably secure the adjustable bandana to the head. The first and second fasteners may be hook and loop type fasteners. Releasable engagement of the fasteners allows the user to adjustably secure the adjustable bandana about the head.

Further, the user may selectively display emblems secured to the fabric sheet when the adjustable bandana is worn by the user. The fabric sheet may further include user-selectable indicia imprinted thereon.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
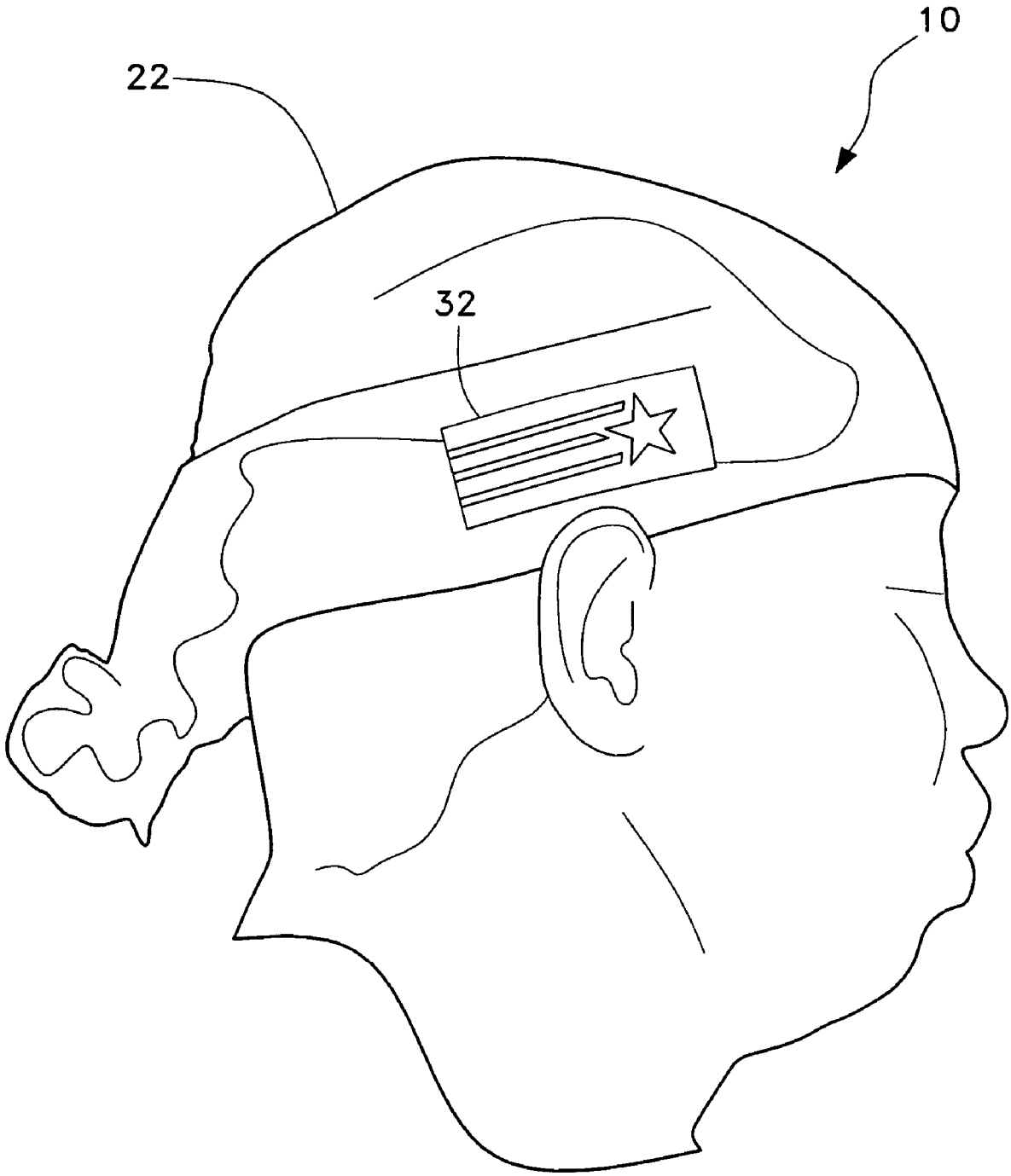
FIG. 1 is an environmental, perspective view of an adjustable bandana according to the present invention.

As shown in FIG. 1, the adjustable bandana 10 may be worn as a head covering to absorb perspiration, provide protection, or to provide warmth. As will be described in greater detail below, although shown as a head covering in FIG. 1, the adjustable bandana 10 may be configured for use to cover or support other parts of the body, and is adjustable in both size and configuration. The adjustable bandana 10 is formed from a fabric sheet having an upper surface 22 and a lower surface 12. The fabric sheet may be an athletic or nylon mesh, cloth, felt or any other suitable breathable material selected for comfort and providing the ability to absorb perspiration and cool the user's head through evaporative cooling.

Figure 2:
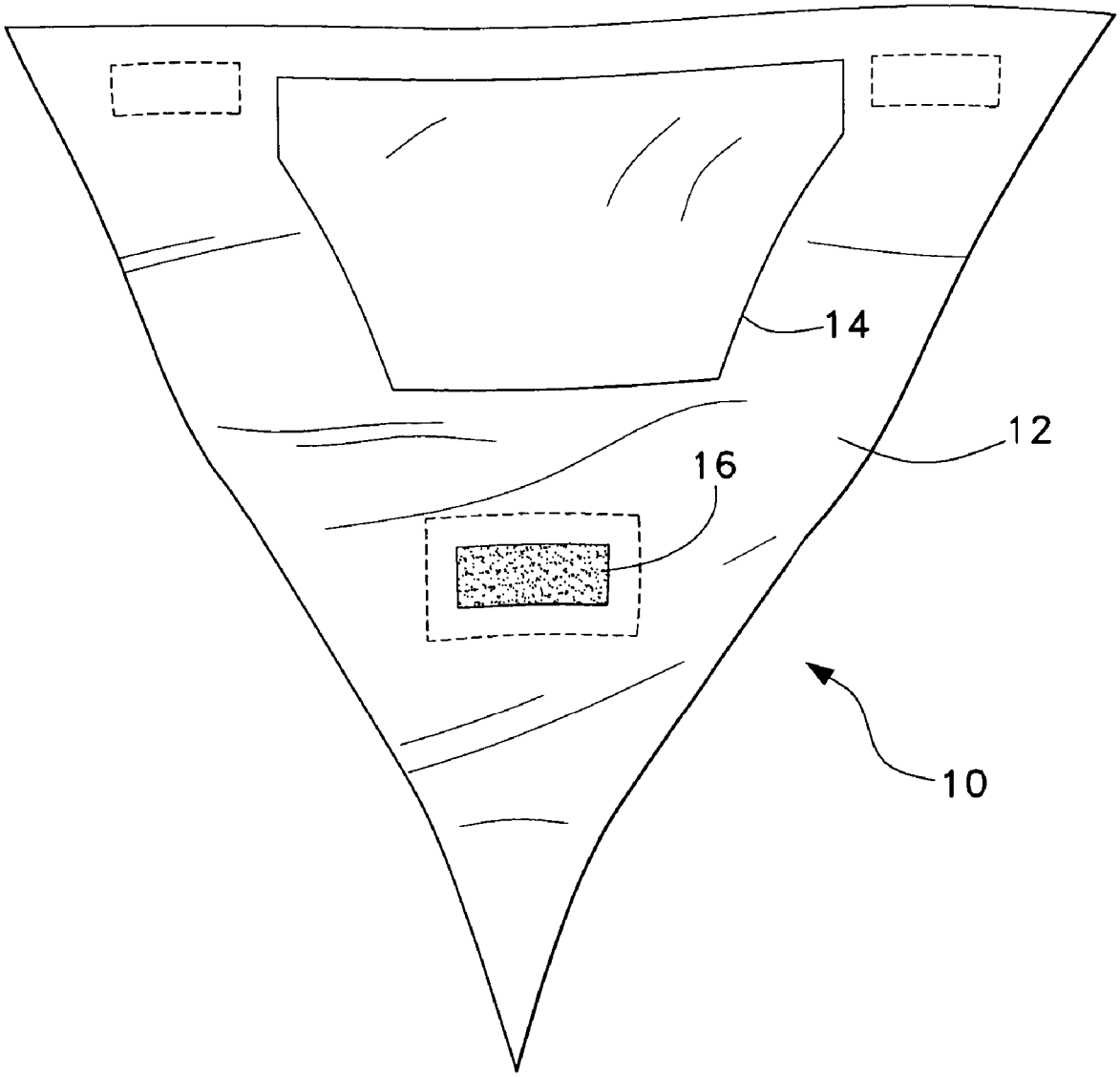
FIG. 2 is a bottom view of a partially assembled adjustable bandana according to the present invention.

An absorption layer 14 is secured to the lower surface 12 of the fabric sheet, as best shown in FIG. 2. The absorption layer 14 is formed from a material, such as, for example, microfleece-type fabric, which absorbs perspiration, wicks the perspiration away from the user's skin and cools the user through evaporative cooling. When worn as a head covering, as shown in FIG. 1, the absorption layer 14 covers the user's scalp and forehead. When worn in cold climates, the absorption layer 14 provides for additional thermal insulation.

In FIG. 2, the fabric sheet is shown as having a substantially triangular contour and the absorption layer is shown as having a substantially trapezoidal contour. It should be understood that the fabric sheet and absorption layer may take any desired shape. Further, the fabric sheet and absorption layer may be produced in a variety of sizes to accommodate a variety of different users; for example, smaller sizes may be produced for children. Further, the fabric sheet may be a single piece of fabric, or may be a pair of fabric pieces, joined each to the other, to form a unitary fabric sheet.

Figure 3:
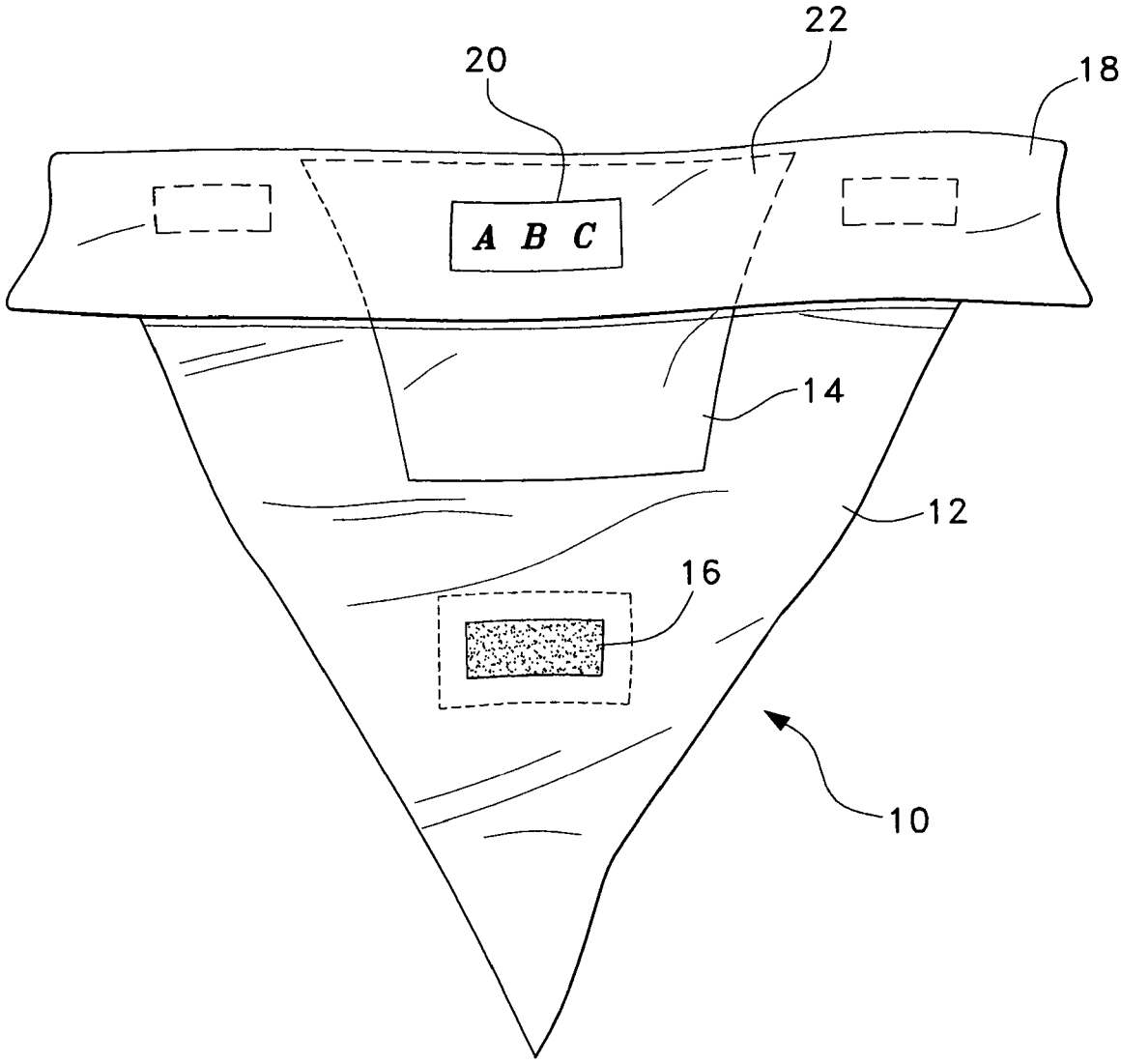
FIG. 3 is a bottom view of an assembled adjustable bandana according to the present invention.
Figure 5A:
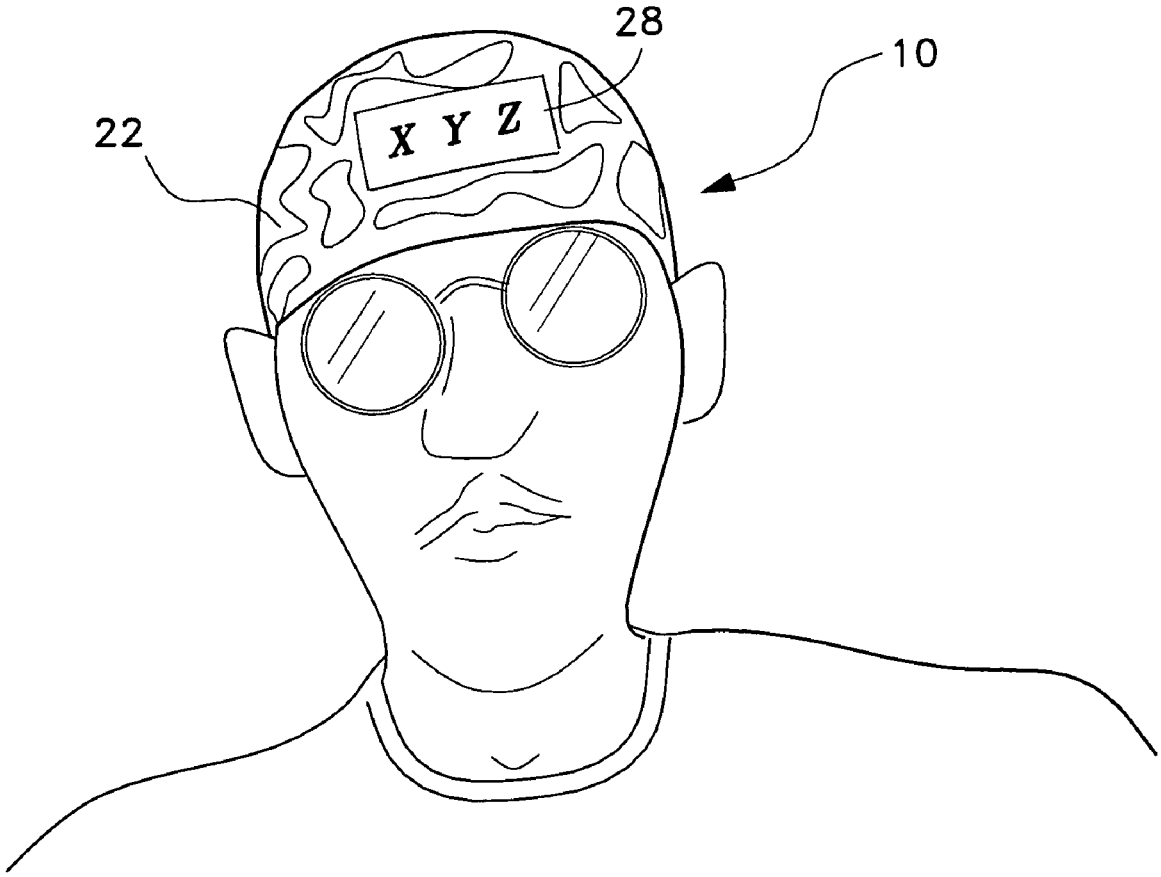
FIG. 5A is an environmental front view an adjustable bandana according to the present invention displaying a first emblem.
Figure 5B:
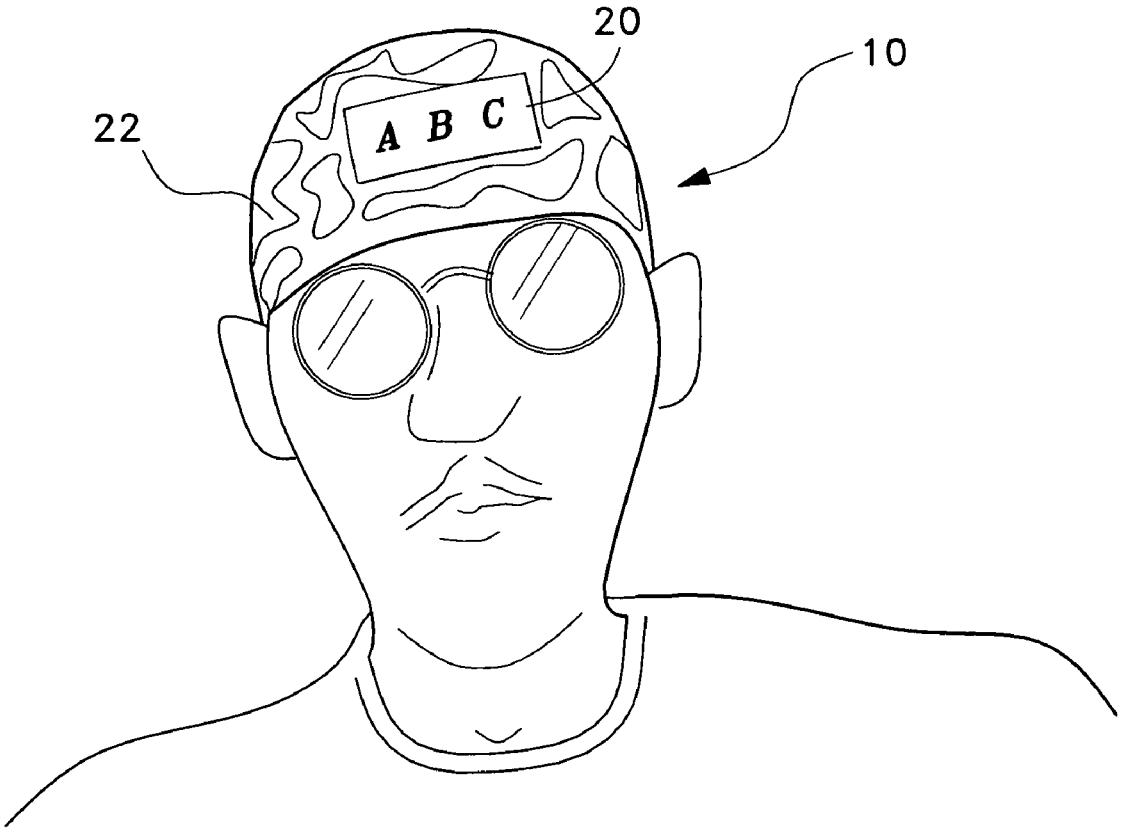
FIG. 5B is an environmental front view of the adjustable bandana of FIG. 5A with the flap reversed to display a second emblem.

As shown in FIG. 3, when fully assembled, the top portion of the fabric sheet of FIG. 2 is folded down and secured to form a flap 18. Flap 18 is secured to lower surface 12 through stitching or through any other suitable method of fastening fabric. Flap 18 provides a thicker region of fabric material, thus providing for the enhanced absorption of perspiration. As shown in FIGS. 1, 5A and 5B, when worn as headgear, flap 18 is positioned on the user's forehead, and prevents perspiration from dripping into the user's eyes. Optionally, an elastic band may be secured to lower surface 12, fixed between closures 24, allowing the adjustable bandana 10 to be tightly secured to body parts of varying sizes.

Figure 4:
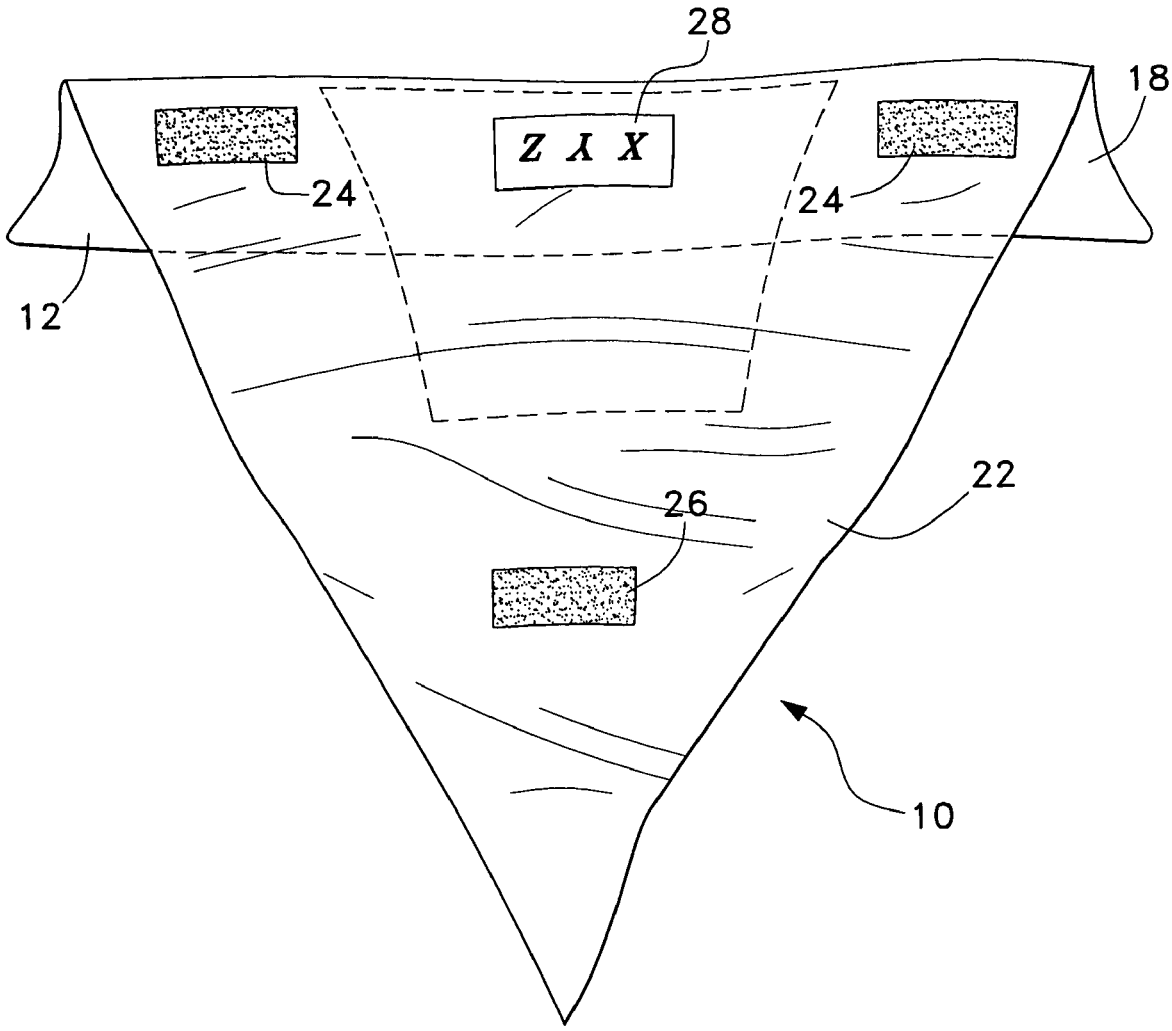
FIG. 4 is a top view of an adjustable bandana according to the present invention.

Further, flap 18 forms an emblem mounting region. As shown in FIG. 3, first emblem 20 is mounted to upper surface 22 on flap 18. As shown in FIG. 4, second emblem 28 is mounted on the reverse surface of adjustable bandana 10. Emblems 20 and 28 may be patches fixed to flap 18 through stitching or other conventional methods. When worn on the head, the user may selectively choose to display second emblem 28, as shown in FIG. 5A, or the user may flip up the emblem mounting region to display first emblem 20, as shown in FIG. 5B. Additionally, as shown in FIG. 1, additional emblems, such as side patch 32, may be added.

With flap 18 acting as a region specifically adapted for the mounting of emblems and the selective display of emblems, the user may selectively choose an emblem to be displayed without first having to remove an initially displayed emblem; i.e., if the user initially displays emblem 28, as in FIG. 5A, and decides to display emblem 20, as in FIG. 5B, the user does not first have to remove emblem 28 from the adjustable bandana 10. The user merely has to flip up the emblem mounting region, covering emblem 28 and displaying emblem 20, thus saving time and energy, and further allowing the user to subsequently selectively display emblem 28 and hide emblem 20, if the user so desires.

First connectors 24 are secured to upper surface 22, along opposite ends thereof, as shown in FIG. 4. First connectors 24 may be hook and loop fasteners, fixed to the fabric sheet through stitching or other suitable methods of attachment, for selective and adjustable engagement with mating hook and lop fastener 26, secured to the lower end of upper surface 22, as shown. The engagement of hook and loop fasteners 24 and 26 allows for the selective closure of the adjustable bandana about the head, or other body part, and provides for a selectively adjustable size to fit heads of different diameter.

Additionally, as shown in FIG. 3, a hook and loop fastener 16 may also be secured to lower surface 12, also for engagement hook and loop fasteners 24. The user may selectively choose to fasten the hook and loop fasteners 24 to either fastener 26 on the upper surface 22 or fastener 1 6 on the lower surface. The use of fastener 16 allows the user to produce a "skullcap" type appearance for adjustable bandana 10, particularly when the fabric sheet includes the tail portions, shown in FIG. 1. The protruding tail portions may more easily be tucked underneath the head covering portion of the adjustable bandana 10 when loop-type fasteners 24 engage the hook-type fasteners 16 on the lower surface. It should be noted that the orientation of hook and loop fasteners 16, 24 and 26 are dependent upon the needs and desires of the user.

Figure 6:
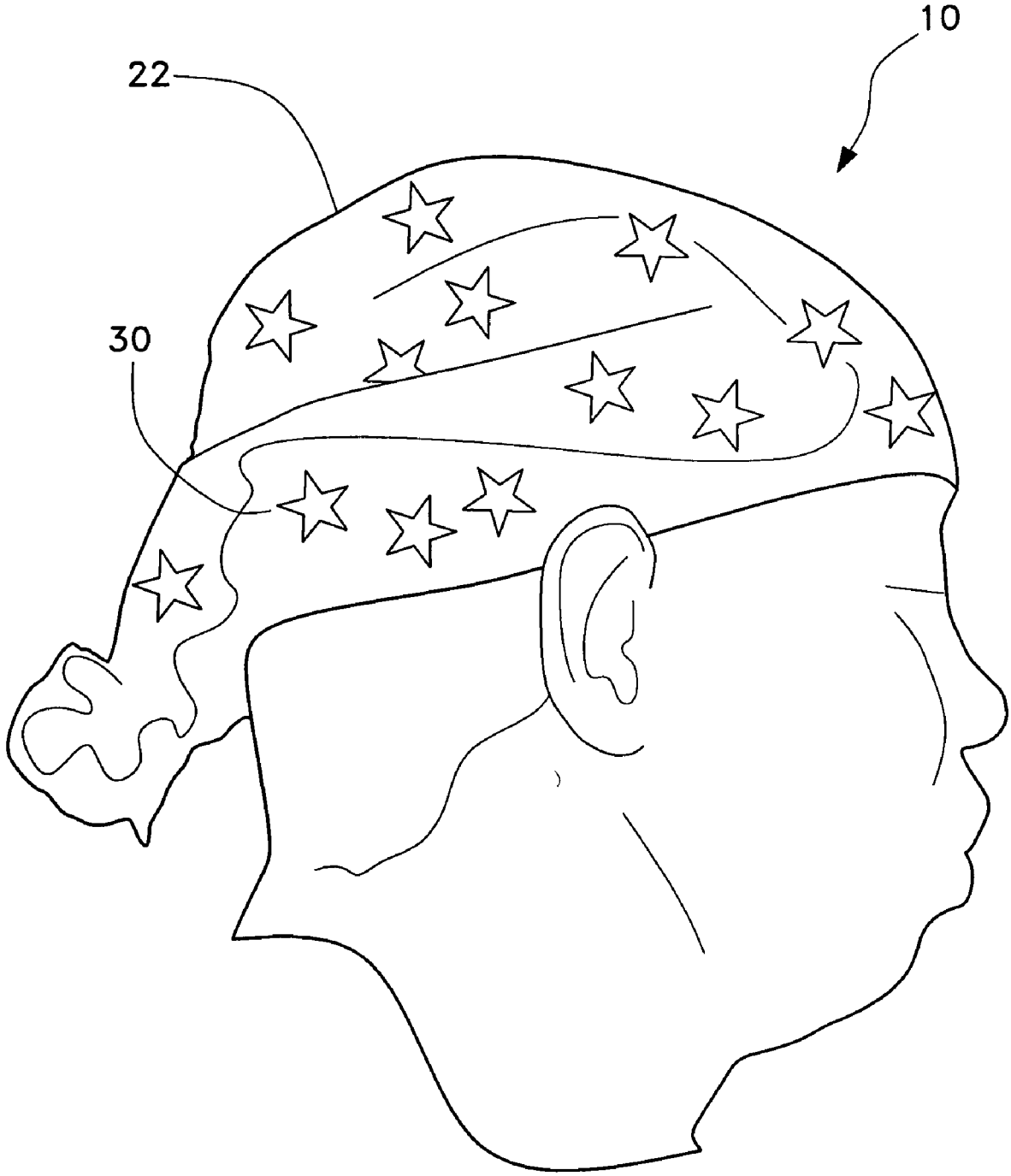
FIG. 6 is an environmental side view of an alternative embodiment of the adjustable bandana of the present invention.

It should be noted that when worn on the head, the ends of flap 18 form a decorative tail portion, as shown in FIG. 1. However, as noted above, the fabric sheet may have any desired shape, which may result in, for example, an adjustable bandana 10 having no decorative tail. The shape, style and configuration of adjustable bandana 10 are dependent upon the needs and desires of the user. Further, as shown in FIG. 6, the adjustable bandana may have user-selected indicia 30 imprinted thereon.

Figure 7:
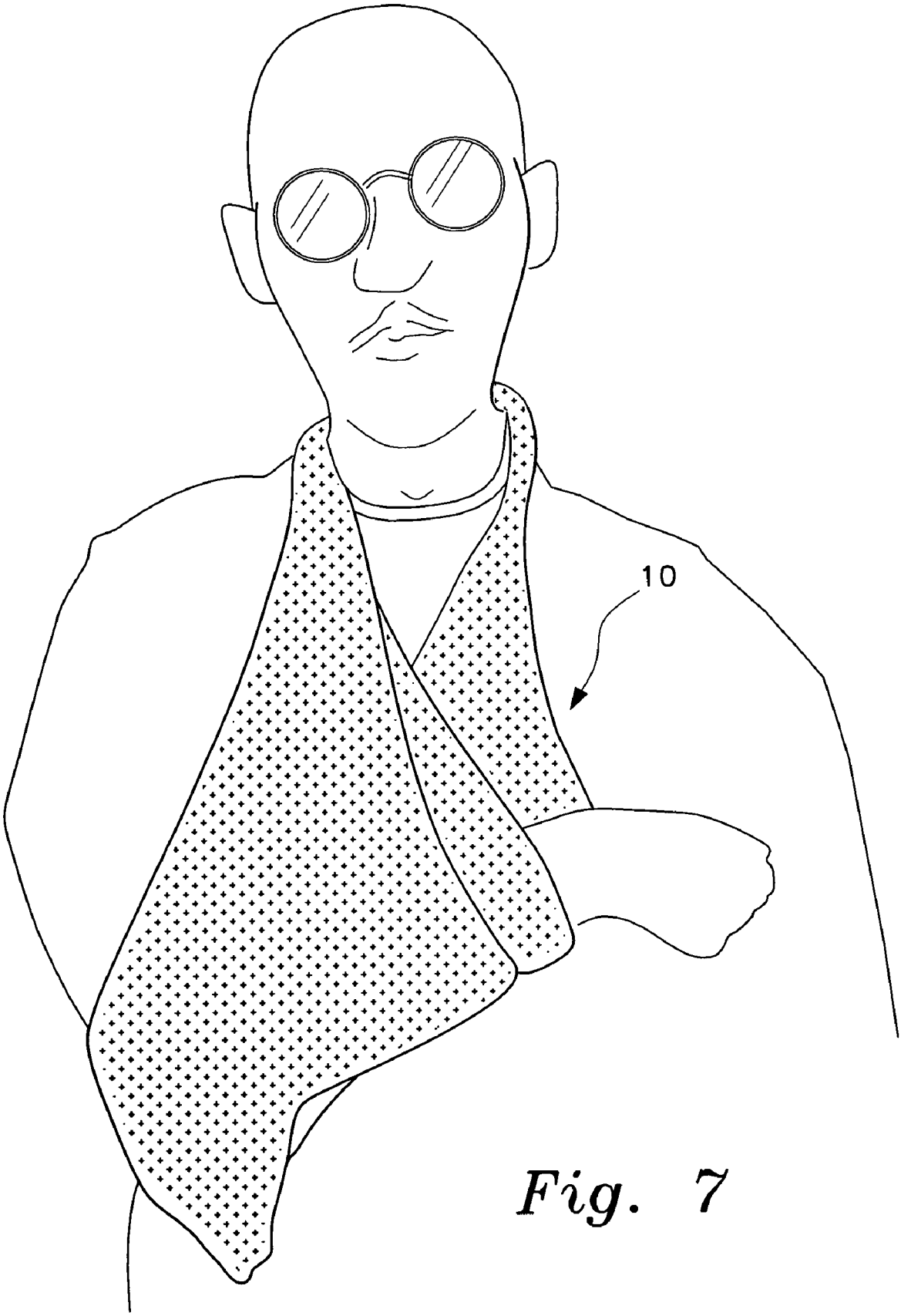
FIG. 7 is an environmental perspective view of the adjustable bandana of the present invention configured for use as a sling.

As shown in FIG. 7, the adjustable bandana 10 may further be adapted for other uses. FIG. 7 illustrates a user wearing adjustable bandana 10 on his shoulder and arm to form a sling. In this particular configuration, the opposed ends of flap 18 are tied behind the user's neck, and the user's arm rests in the central portion of the fabric sheet. The absorption layer 14 contacts the user's skin, even in this sling configuration, providing comfort for the user and reducing the risk of skin rashes and other ailments. The adjustable bandana 10 may be used to cover or support any suitable body part or combination of body parts, and is adaptable for a wide variety of applications.

The adjustable bandana 10 provides an absorbent, adjustable, insulating and protective covering for the head or other body parts. The adjustable bandana 10 is of particular use as headwear, absorbing perspiration from the user's forehead and scalp, which prevents perspiration from dripping in the user's eyes and further provides a cooling effect for the user through evaporative cooling. The adjustable bandana 10 may be worn by athletes, may be worn under helmets, or may be worn for thermal insulation in cold climates. The adjustable bandana is highly adaptable to a variety of different situations and may be produced in a variety of shapes and sizes to accommodate different types of users and to be applied to a multiplicity of body parts. The adaptability of the adjustable bandana 10 allows bandana 10 to be worn as a head covering, a cravat, a wrap for babies, a towel, a sling, as shown in FIG. 7, or as a cover or support for any other body part the user desires to cover or support.

It is to be understood that the present invention is not limited to the embodiments described above, but encompasses any and all embodiments within the scope of the following claims.

I claim:

1. An adjustable bandana, comprising:

a generally triangular shaped fabric sheet having an upper surface and a lower surface, the fabric sheet having a proximal end and a distal end, the upper surface having a first emblem mounting region adjacent the proximal end, the lower surface having a second emblem mounting region adjacent the proximal end;

an absorbent layer having a generally trapezoidal shape secured to the lower surface of the fabric sheet, said absorbent layer partially covering said lower surface of said fabric sheet, said absorbent layer being formed from a material different than said fabric sheet;

a pair of first fasteners of a first configuration secured to the upper surface of the fabric sheet, the pair of first fasteners being positioned adjacent the proximal end, said pair of first fasteners configured to mate with and be releasably secured to a fastener of a second configuration;

at least one second fastener of a second configuration secured to the upper surface of the fabric sheet, the at least one second fastener being positioned adjacent the distal end, said at least one second fastener configured to mate with and be releasably secured to said pair of first fasteners; and, first and second emblems respectively secured to said first and second emblem mounting regions;

whereby a user covers a body part with the fabric sheet, the absorbent layer contacting the body part to absorb perspiration, the pair of first fasteners engaging and releasably secured to the second fastener to releasably and adjustably secure the fabric sheet to the body part;

wherein further the user may selectively display said first or second emblems, said second emblem mounting region selectively covering said first emblem mounting region, whereby said first emblem is covered by said second emblem mounting region when said second emblem is selectively displayed, the user being able to alternate the display of said first and second emblems without removal of the adjustable bandana from the body part of the user.

2. The adjustable bandana as recited in claim 1, wherein said pair of first fasteners and said at least one second fastener comprise mating hook and loop fasteners.

3. The adjustable bandana as recited in claim 1, further comprising at least one third fastener of said second configuration secured to the lower surface adjacent said distal end, whereby the user may selectively engage said pair of first fasteners with said at least one second fastener or with said at least one third fastener.

4. The adjustable bandana as recited in claim 1, wherein said fabric sheet is formed from a pair of fabric members joined each to the other along peripheries thereof.

5. The adjustable bandana as recited in claim 1, wherein said fabric sheet further comprises indicia imprinted thereon.

* * * * *